US010932032B2

(12) United States Patent
Huang

(10) Patent No.: US 10,932,032 B2
(45) Date of Patent: Feb. 23, 2021

(54) ACOUSTIC DEVICE

(71) Applicant: Advanced Semiconductor Engineering, Inc., Kaohsiung (TW)

(72) Inventor: Ming-Tau Huang, Kaohsiung (TW)

(73) Assignee: ADVANCED SEMICONDUCTOR ENGINEERING, INC., Kaohsiung (TW)

( * ) Notice: Subject to any disclaimer, the term of this patent is extended or adjusted under 35 U.S.C. 154(b) by 0 days.

(21) Appl. No.: 16/228,337

(22) Filed: Dec. 20, 2018

(65) Prior Publication Data

US 2020/0204908 A1 Jun. 25, 2020

(51) Int. Cl.
*H04R 1/28* (2006.01)
*H04R 1/10* (2006.01)

(52) U.S. Cl.
CPC ..... *H04R 1/2819* (2013.01); *H04R 1/1016* (2013.01); *H04R 1/1033* (2013.01); *H04R 1/1075* (2013.01)

(58) Field of Classification Search
CPC .. H04R 1/1091; H04R 1/2811; H04R 1/1016; H04R 2201/10; H04R 1/2857; H04R 25/456; H04R 25/606; H04R 29/00; H04R 29/001; H04R 7/00; H04R 7/04; H04R 7/18; H04R 7/20; H04R 9/02; H04R 9/045; H04R 9/046; H04R 9/063; H04R 9/066; H04N 5/2256; H04N 5/23293; H04N 5/2354; H04N 5/332; H04N 5/374; H04N 7/18; H04N 7/183; H04N 5/33; H04N 7/185
USPC ..... 381/312, 322, 328, 335, 345, 372; 181/129
See application file for complete search history.

(56) References Cited

U.S. PATENT DOCUMENTS 5,327,507 A * 7/1994 Suzuki ..... H04R 1/1016 381/345
5,383,566 A * 1/1995 Johnson ..... B29C 53/824 220/562
9,319,767 B2 * 4/2016 Sakaguchi ..... H04R 1/2811
9,578,412 B2 * 2/2017 Azmi ..... H04R 1/1091
2008/0267438 A1 * 10/2008 Chen ..... H04R 1/2811 381/345
2011/0261987 A1 * 10/2011 Nakanishi ..... H04R 19/04 381/355
2014/0321672 A1 * 10/2014 Yeh ..... H04R 1/02 381/119

(Continued)

FOREIGN PATENT DOCUMENTS

CN 206620266 * 11/2017 ..... H04R 1/10
WO WO-2015/027521 A1 3/2015

*Primary Examiner* — Lun-See Lao
(74) *Attorney, Agent, or Firm* — Foley & Lardner LLP

(57) ABSTRACT

An acoustic device includes a first chamber, a first through hole, a vibration structure, and a separation structure. The first chamber includes a first end and a second end. The first through hole is defined at the first end of the first chamber. The vibration structure is disposed at the second end of the first chamber and is configured to transmit an acoustic wave away from the first chamber. The separation structure is disposed within the first chamber and divides the first chamber into a first sub-chamber and a second sub-chamber. The separation structure defines a second through hole connecting the first sub-chamber and the second sub-chamber.

28 Claims, 8 Drawing Sheets

(56) References Cited

U.S. PATENT DOCUMENTS

2016/0192065 A1* 6/2016 Oosato ..... H04R 1/2826
381/378
2017/0366889 A1* 12/2017 Schipper ..... H04R 1/086

* cited by examiner

ACOUSTIC DEVICE

BACKGROUND

1. Technical Field

The present disclosure relates generally to an acoustic device, and more particularly, the present disclosure relates to an acoustic device including a chamber.

2. Description of the Related Art

Acoustic devices (such as earphones) have become very popular as more and more people wear portable electronic devices, such as MP3-players and mobile phones. To improve the acoustic performance of an acoustic device, low-frequency resonance plays an important role. However, comparative acoustic devices do not provide sufficient low-frequency resonance due to constrained volume.

SUMMARY

In one aspect, according to some embodiments, an acoustic device includes a first chamber, a first through hole, a vibration structure, and a separation structure. The first chamber includes a first end and a second end. The first through hole is defined at the first end of the first chamber. The vibration structure is disposed at the second end of the first chamber and is configured to transmit an acoustic wave away from the first chamber. The separation structure is disposed within the first chamber and divides the first chamber into a first sub-chamber and a second sub-chamber. The separation structure defines a second through hole connecting the first sub-chamber and the second sub-chamber.

In another aspect, according to some embodiments, an acoustic device includes a first chamber, a first through hole, a vibration membrane, and a separation structure. The first chamber includes a first end and a second end. The first through hole is defined at the first end of the first chamber. The vibration membrane is disposed at the second end of the first chamber and is configured to transmit an acoustic wave away from the first chamber. The separation structure is disposed within the first chamber and defines a first sub-chamber and a second sub-chamber. The separation structure defines a second through hole connecting the first sub-chamber and the second sub-chamber. A volume of the first sub-chamber is greater than a volume of the second sub-chamber.

In yet another aspect, according to some embodiments, an acoustic device includes a first chamber, a second chamber, a membrane and a separation structure. The membrane is disposed between the first chamber and the second chamber. The separation structure is disposed within the second chamber to divide the second chamber into a first sub-chamber and a second sub-chamber. The separation structure has a first hole connecting the first sub-chamber and the second sub-chamber. The second chamber has a second hole penetrating the second chamber.

BRIEF DESCRIPTION OF THE DRAWINGS

Aspects of the present disclosure are best understood from the following detailed description when read with the accompanying drawings. It is noted that various features may not be drawn to scale, and, in the drawings, the dimensions of the depicted features may be arbitrarily increased or reduced for clarity of discussion.

Common reference numerals are used throughout the drawings and the detailed description to indicate the same or similar elements. The present disclosure will be more readily understood from the following detailed description taken in conjunction with the accompanying drawings.

DETAILED DESCRIPTION

According to some embodiments of the present disclosure, by way of a separation structure in a chamber of an acoustic device such as an earphone to define two sub-chambers within the chamber, low-frequency resonance can be improved without increasing the volume of the acoustic device. In some embodiments, by way of through holes on the separation structure and on an end of the chamber, acoustic distortion can be reduced or prevented.

Figure 1:
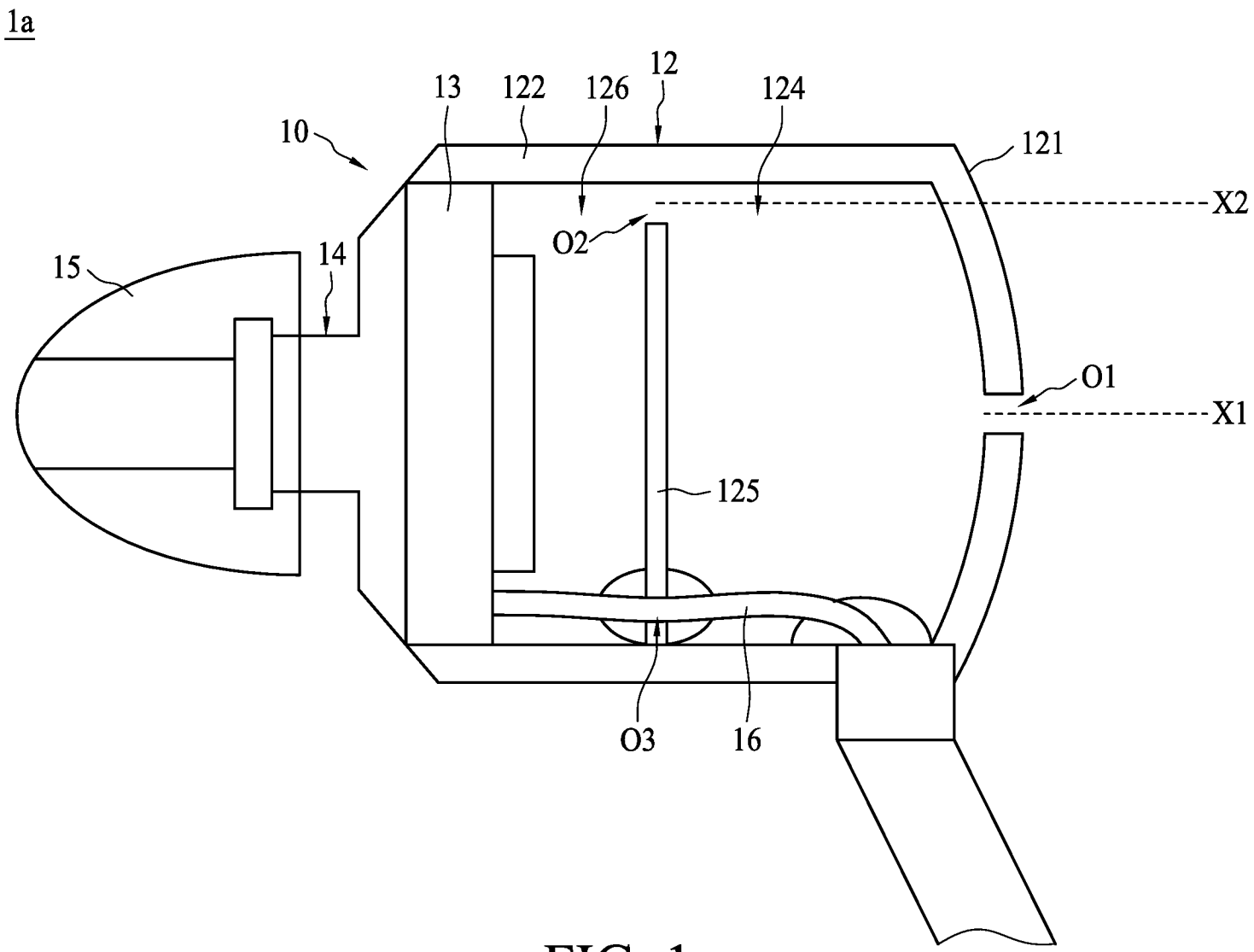
FIG. 1 illustrates a cross-sectional view of an acoustic device in accordance with some embodiments of the present disclosure.

FIG. 1 illustrates a cross-sectional view of an acoustic device 1*a* in accordance with some embodiments of the present disclosure.

The acoustic device 1*a* includes chambers 12, 14, a vibration structure 13, a separation structure 125, a cushion 15, and an audio wire 16. The acoustic device 1*a* may be a headphone such as an intra-concha earphone or an earbud headphone.

The chamber 12 and the chamber 14 form or define a housing 10. The housing 10 may be sized, shaped and/or configured to rest within the concha of an ear of a user. The cushion 15 is combined with the housing 10 and faces towards the ear. In the embodiment shown in FIG. 1, the cushion 15 at least partially covers a portion of the chamber 14.

The vibration structure 13 is disposed between the chamber 12 and the chamber 14. The vibration structure 13 is configured to convert an electrical audio signal received through the audio wire 16 into a sound or an acoustic wave. The vibration structure 13 may transmit an acoustic wave in two directions. For example, the vibration structure 13 may transmit an acoustic wave away from the chamber 12 and towards the cushion 15, or away from the cushion 15 and towards the chamber 12. The vibration structure 13 may be an acoustic driver driven by the audio wire 16. In some embodiments, the vibration structure 13 may be driven via a wireless connection with an external device. In some embodiments, the vibration structure 13 may be or may include a vibration membrane. The vibration structure 13 may include an elastic material.

The chamber 12 includes an end 121 away from the vibration structure 13 and an end 122 opposite to the end 121. The end 122 of the chamber 12 is adjacent to the chamber 14. The vibration structure 13 is disposed at the end 122 of the chamber 12. As shown in FIG. 1, a through hole (or a vent hole, an aperture) O1 is defined or located at a surface of the end 121 of the chamber 12. The through hole O1 penetrates a wall or a shell of the chamber 12. In some embodiments, the through hole O1 may have a diameter in a range between 0.6 mm and 0.9 mm. In some embodiments, the through hole O1 may have a diameter in a range between 0.7 mm and 0.8 mm.

The separation structure 125 is disposed within the chamber 12 and divides the chamber 12 into a sub-chamber 124 and a sub-chamber 126. A through hole (or a vent hole, an aperture) O2 is defined at the separation structure 125. The through hole O2 penetrates through the separation structure 125 and connects the sub-chamber 124 and the sub-chamber 126. In some embodiments, a volume of the sub-chamber 124 is equal to or greater than a volume of the sub-chamber 126. In other embodiments, the volume of the sub-chamber 124 may be less than or equal to two times the volume of the sub-chamber 126. The separation structure 125 may increase a structural strength of the acoustic device 1*a*.

In the embodiment shown in FIG. 1, a central axis X1 of the through hole O1 is different from or spaced apart from a central axis X2 of the through hole O2. That is, a projection of the through hole O1 on the separation structure 125 does not overlap the through hole O2. However, the present disclosure is not limited thereto. In some embodiments, the central axis X1 of the through hole O1 is the same as the central axis X2 of the through hole O2. That is, a projection of the through hole O1 on the separation structure 125 may overlap the through hole O2. In some embodiments, a volume defined by or within the through hole O1 is greater than a volume defined by or within the through hole O2. For example, a ratio of the volume defined by the through hole O1 to the volume defined by the through hole O2 is greater than 1 and equal to or less than 1.2. In some embodiments, the ratio may be greater than 1.2. The configuration of the through holes O1 and O2 may facilitate a pressure balance within the chamber 12 (or between the sub-chamber 124 and the sub-chamber 126) during vibration of the vibration structure 13. The configuration of the through holes O1 and O2 may also increase the path of the acoustic wave transmitted within the chamber 12, so as to increase the acoustic performance (especially for low-frequency resonance) of the acoustic device 1*a*. In some embodiments, the separation structure 125 may define more than one through hole.

The separation structure 125 further defines a hole O3 for the audio wire 16 to pass through and to be coupled to the vibration structure 13. The audio wire 16 may be used to transmit an electrical signal to drive the vibration structure 13 to generate sound or an acoustic wave. In some embodiments, an adhesive material (not shown) may be used to fix the audio wire 16 in the hole O3. The adhesive material may seal a space between the audio wire 16 and the hole O3. The adhesive material may fill a space in the hole O3 between the audio wire 16 and the separation structure 125. Therefore, the audio wire 16 is tightly fixed and is more robust against or has more resistance against a pull-out strength.

Figure 2A:
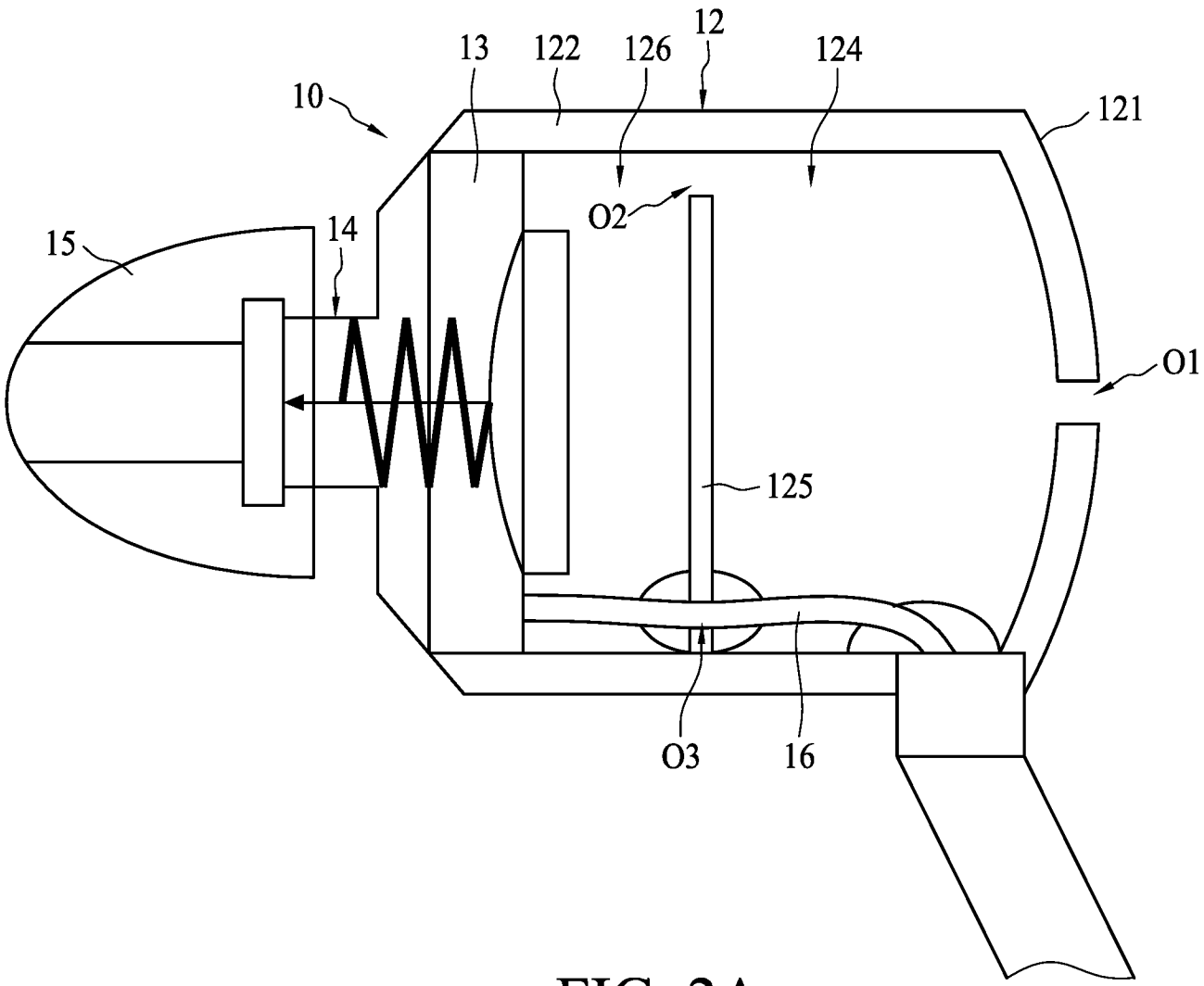
FIG. 2A, FIG. 2B, FIG. 2C and FIG. 2D are cross-sectional views of the acoustic device in FIG. 1 at various working stages.
Figure 2B:
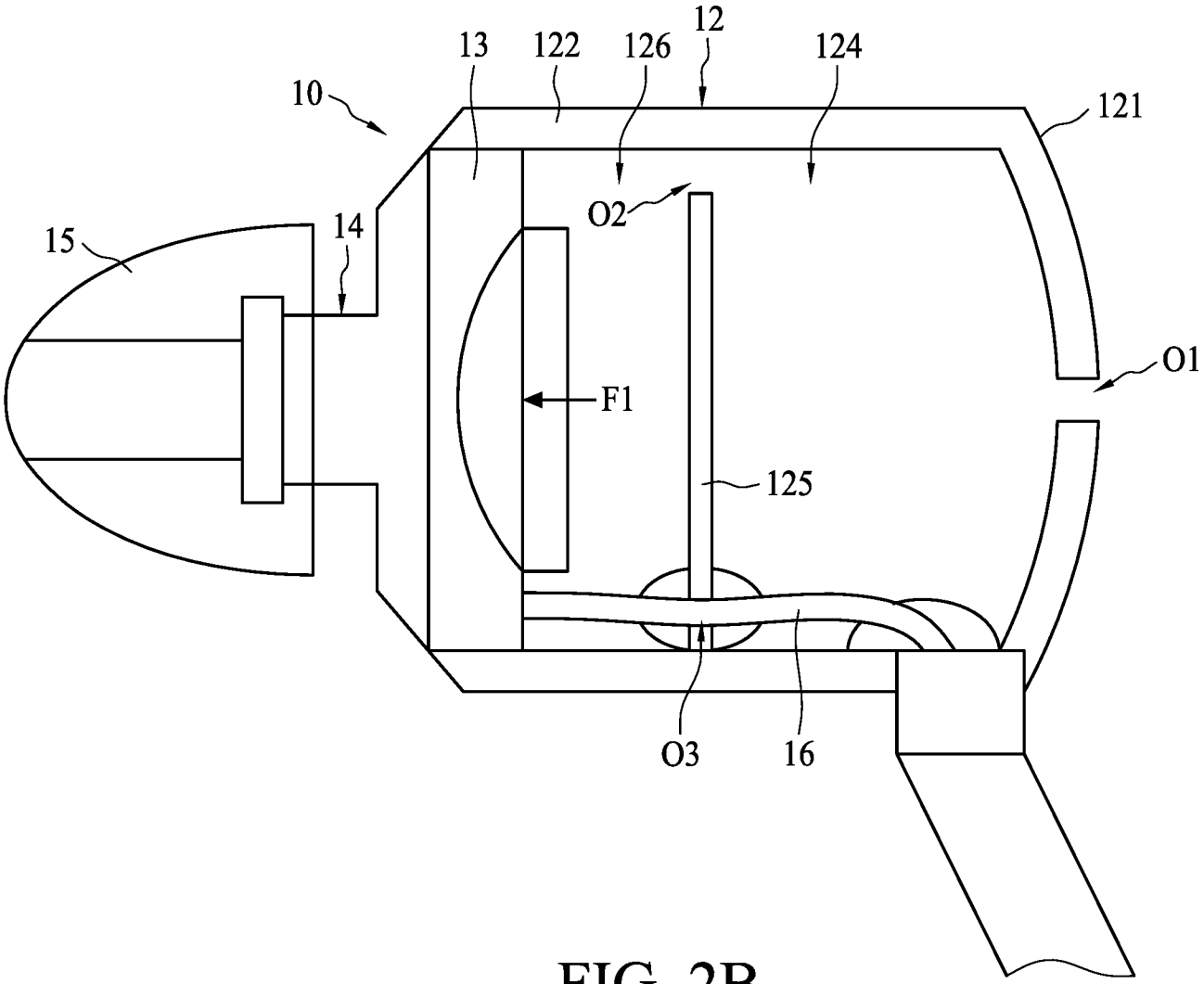

FIG. 2A, FIG. 2B, FIG. 2C and FIG. 2D are cross-sectional views of the acoustic device 1*a* in FIG. 1 at various working stages. FIG. 2A generally illustrates that, upon being driven by an electrical signal, the vibration structure 13 vibrates and generates an acoustic wave towards the cushion 15. The acoustic wave may be composed of various portions including low frequency waves, medium frequency waves and high frequency waves. Low frequency waves often sound "lower" to the human ear and may be ranged between 10 Hz and 200 Hz or lower. Medium frequency waves may be ranged between 200 Hz and 2000 Hz. High frequency waves may be higher than 2000 Hz.

Referring to FIG. 2A, when the vibration structure 13 (or a portion of the vibration structure 13) vibrates or bends towards the cushion 15, an air flow from the sub-chamber 124 to the sub-chamber 126 is generated, wherein external air enters the sub-chamber 124 through the through hole O1 and air in the sub-chamber 124 enters the sub-chamber 126 through the through hole O2. Because the volume of the sub-chamber 124 is greater than or equal to the volume of the sub-chamber 126, a force (or density) F1 of the air flow would be enhanced when the air flow enters the sub-chamber 126. Therefore, a sufficient magnitude of the vibration of the vibration structure 13, or a sufficient displacement of the vibration structure 13, can be achieved with moderate air flow, and momentum of the low frequency portions of the acoustic wave can be enhanced.

Figure 2C:
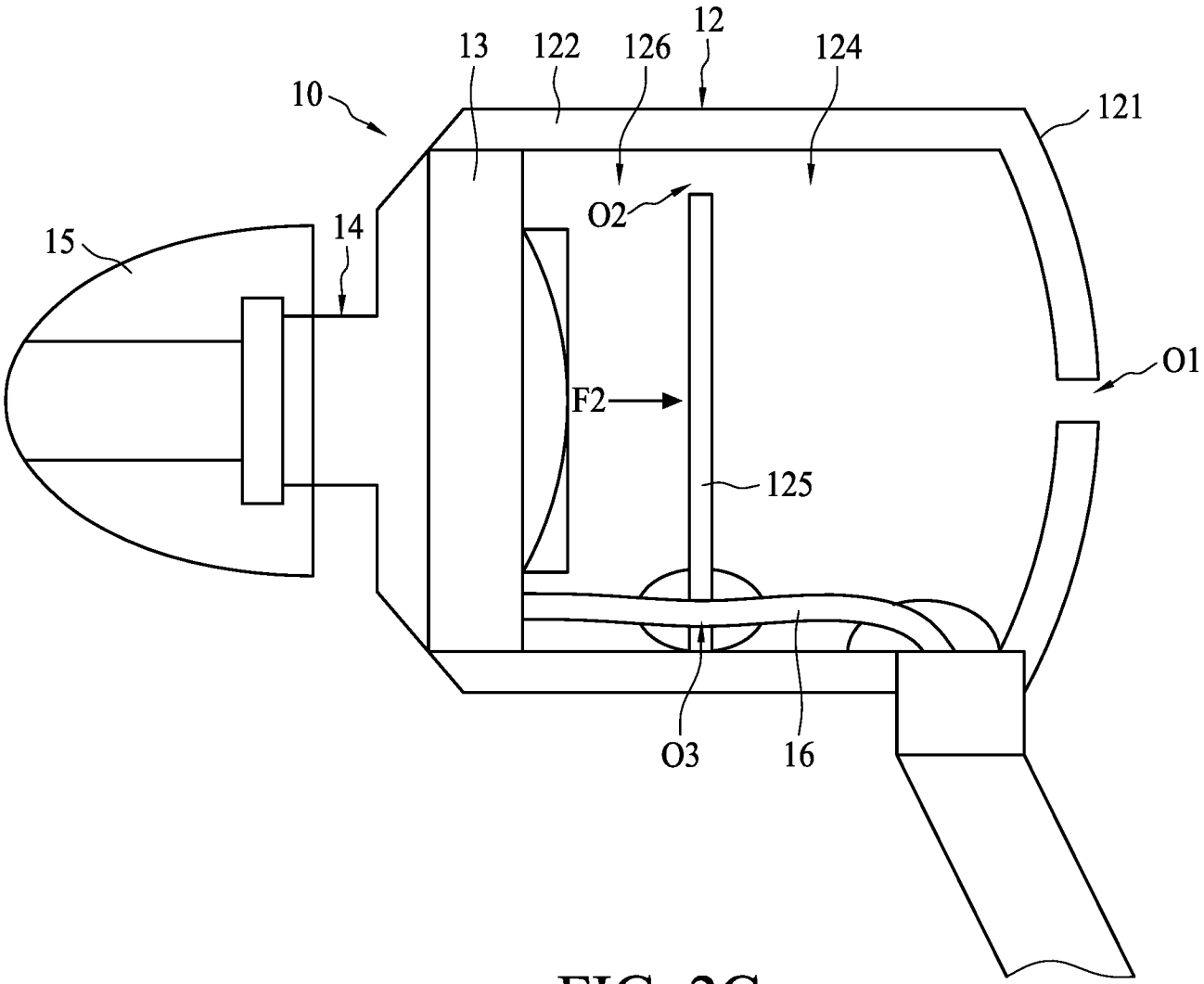

Referring to FIG. 2C, the vibration structure 13 vibrates back or bounces back towards the chamber 12, creating an air pressure and an air flow from the sub-chamber 126 to the sub-chamber 124, wherein air in the sub-chamber 126 enters the sub-chamber 124 through the through hole O2 and air in the sub-chamber 124 flows out through the through hole O1. Because the volume of the sub-chamber 126 is smaller than the volume of the sub-chamber 124, the air that flows from the sub-chamber 126 to the sub-chamber 124 is limited and the speed of the air flow is hindered. Therefore, a magnitude of the vibration of the vibration structure 13, or a displacement of the vibration structure 13, is suppressed, which reduces the time period the vibration structure 13 to recover to its original position. That is, a slower air flow may prevent or reduce delay during recovery of the vibration structure 13 that may otherwise occur due to movement of a large volume of air and may cause sound distortion. In addition, due to the design of the through hole O1 on the chamber 12, the space within the sub-chamber 124 and the space within the sub-chamber 126 are connected to the external atmosphere, which may improve the pressure balance performance and reduce sound distortion. Therefore, the present disclosure may reduce or prevent a sound distortion.

Figure 2D:
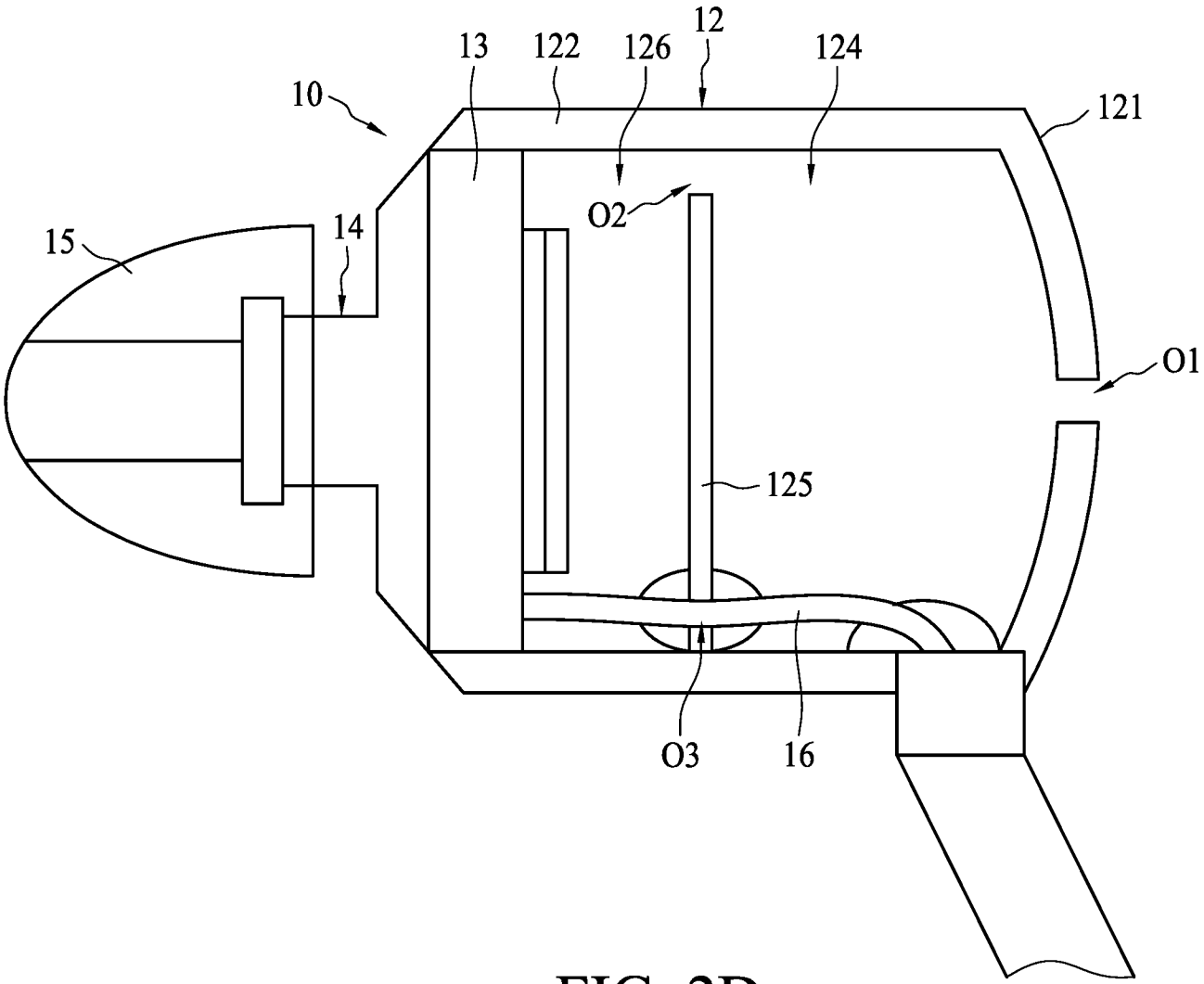

FIG. 2D illustrates that the vibration structure 13 returns back to its original location and is ready for a subsequent vibration.

Figure 3:
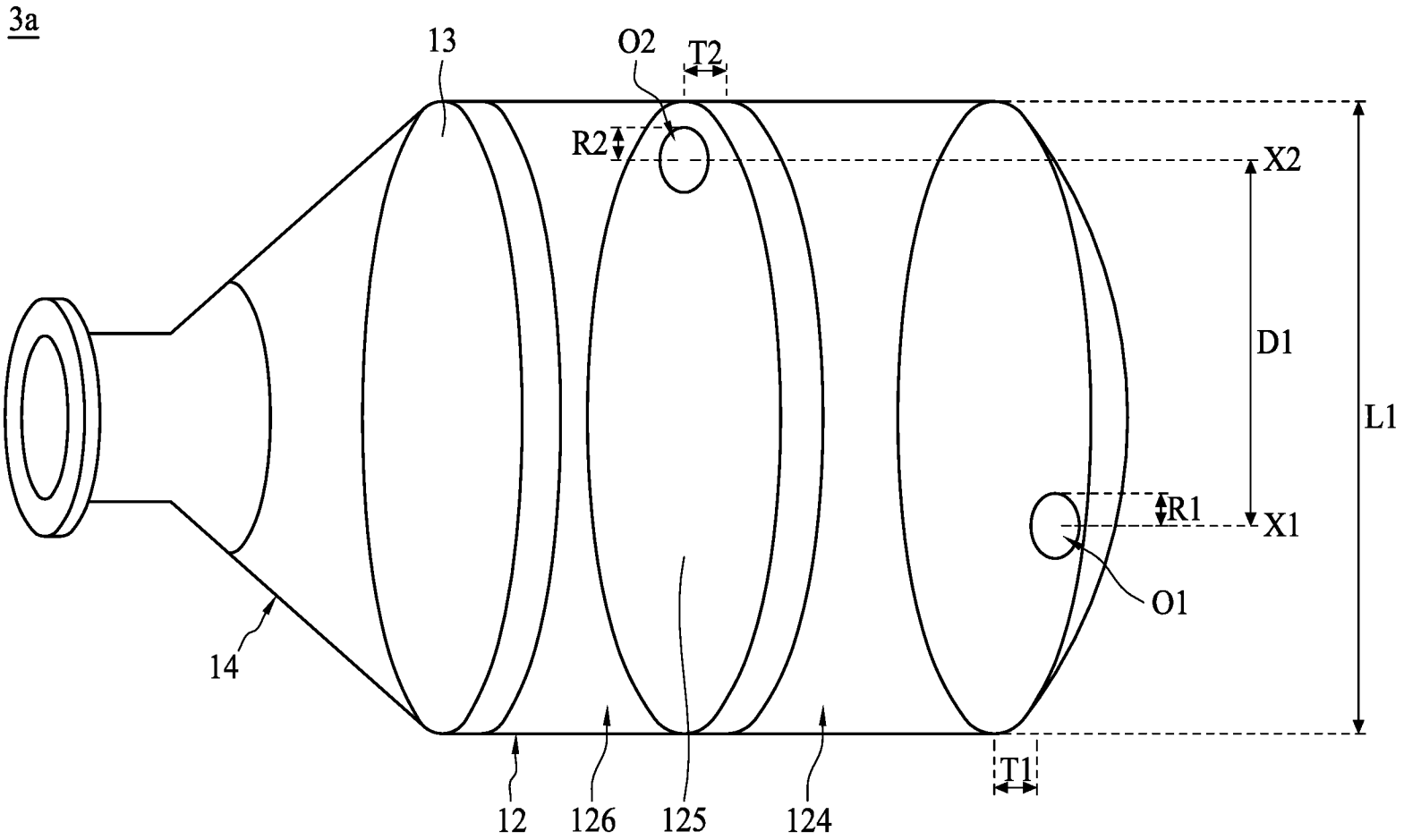
FIG. 3 illustrates a perspective view of an acoustic device in accordance with some embodiments of the present disclosure.

FIG. 3 illustrates a perspective view of an acoustic device 3*a* in accordance with some embodiments of the present disclosure. The acoustic device 3*a* may be the same as or similar to the acoustic device 1*a* in FIG. 1. Some components are omitted. For example, the cushion 15 and the audio wire 16 are omitted.

In the embodiment shown in FIG. 3, the central axis X1 of the through hole O1 on the chamber 12 is different from or spaced apart from the central axis X2 of the through hole O2 on the separation structure 125. A distance D1 is defined between the central axis X1 of the through hole O1 and the central axis X2 of the through hole O2. The separation structure 125 defines a length L1. Generally, increasing the distance D1 increases the lengths of the air flows between the sub-chamber 124 and the sub-chamber 126 caused during vibration of the vibration structure 13, and low-frequency resonance of the generated acoustic wave can be improved. In some embodiments, a ratio of the distance D1 to the length L1 may be designed to be close to 1; for example, the ratio may be in a range between 0.5 and 0.9. In some embodiments, the ratio may be in a range between 0.1 and 0.9. According to some embodiments of the present disclosure, a dBSPL (or dB of sound pressure level) of the target resonance frequency point may be enhanced with 3 dB. In other embodiments, the central axis X1 of the through hole O1 may be the same as the central axis X2 of the through hole O2, which also has a better low-frequency resonance compared to the case where no separation structure is disposed in the chamber 12.

In the embodiment shown in FIG. 3, the through hole O1 has a circular shape with a radius R1 and a depth T1 (which may also be a thickness of a shell of the chamber 12). The through hole O2 has a circular shape with a radius R2 and a depth T2 (which may also be a thickness of the separation structure 125). Therefore, the volume V1 of the through hole O1 is $\pi*R^{12}*T1$, and the volume V2 of the through hole O2 is $\pi*R^{22}*T2$. The volume V1 is greater than the volume V2. For example, a ratio of the volume V1 to the volume V2 may be greater than 1 and equal to or less than 1.2. In some embodiments, the ratio of the volume V1 to the volume V2 may be greater than 1.2. The configuration of the volumes of the through holes O1 and O2 may facilitate a pressure balance within the chamber 12 (or between the sub-chamber 124 and the sub-chamber 126) during vibration of the vibration structure 13.

In some embodiments, the separation structure 125 defines more than one through hole. A relation or design rule between a total volume V3 of all the through holes and the volume V1 of the through hole O1 may be the same as or similar to the relation or design rule between the volume V2 of the through hole O2 and the volume V1 of the through hole O1 when the separation structure 125 defines solely one through hole O2. That is, a ratio of the volume V1 to the volume V3 may be greater than 1 and equal to or less than 1.2. In some embodiments, the ratio of the volume V1 to the volume V3 may be greater than 1.2.

Figure 4:
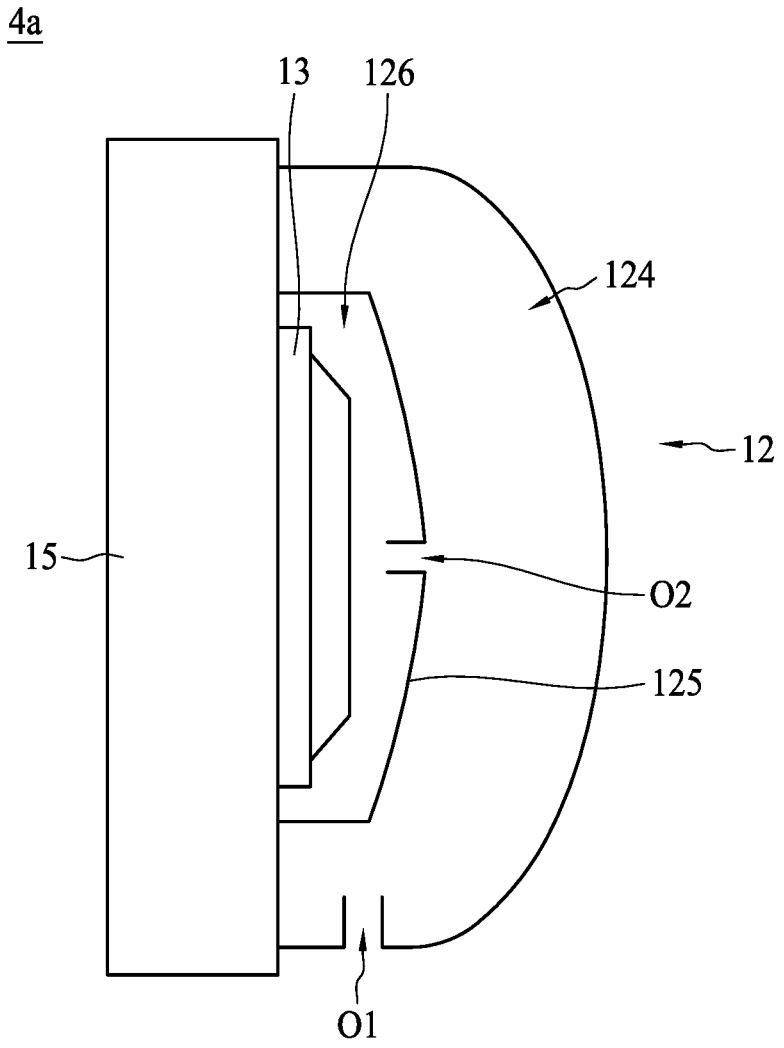
FIG. 4 illustrates a cross-sectional view of an acoustic device in accordance with some embodiments of the present disclosure.

FIG. 4 illustrates a cross-sectional view of an acoustic device 4*a* in accordance with some embodiments of the present disclosure. The acoustic device 4*a* may be a headphone such as a circumaural headphone.

The acoustic device 4*a* includes a cushion 15, a chamber 12, a vibration structure 13, and a separation structure 125. The chamber 12 defines a through hole O1 and the separation structure 125 defines a through hole O2. The separation structure 125 defines a sub-chamber 124 and a sub-chamber 126 within the chamber 12. In some embodiments, the cushion 15, the chamber 12, the vibration structure 13, the separation structure 125, and the through holes O1 and O2 of the acoustic device 4*a* may be the same as or similar to the cushion 15, the chamber 12, the vibration structure 13, the separation structure 125, and the through holes O1 and O2 of the acoustic device 1*a* in FIG. 1.

During application, two acoustic devices 4*a* may be used, corresponding to the right and the left ear of a user. Because of the disposition of the separation structure 125, components such as a battery or a circuit board may be disposed within the sub-chamber 124 of one of the two acoustic devices 4*a*. Therefore, the configurations, arrangements, or volumes of the sub-chambers 126 of the two acoustic devices 4*a* can be substantially the same, which improves the consistency of the frequency responses received by the left and right ears of the user.

Figure 5:
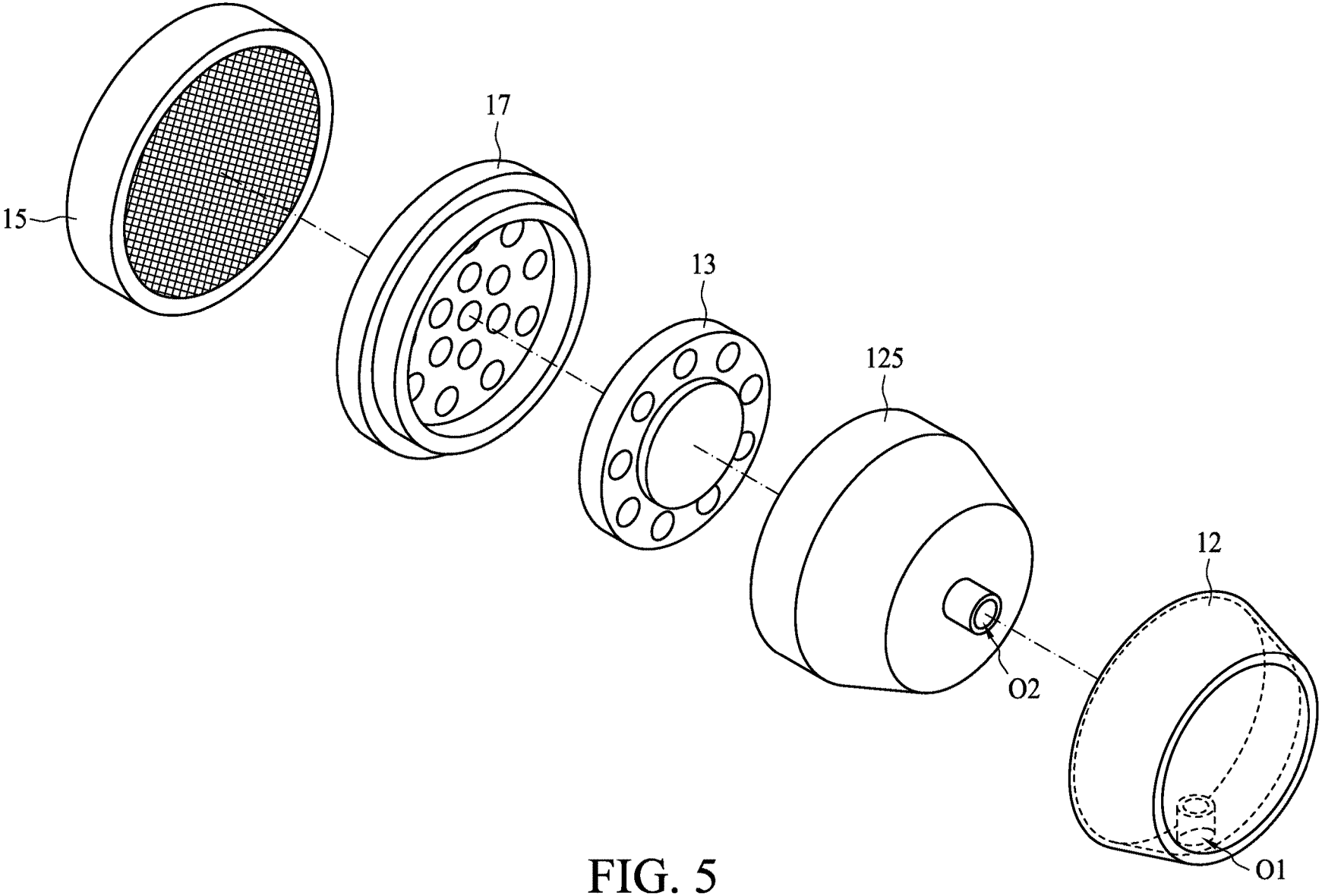
FIG. 5 illustrates an exploded view of an acoustic device in accordance with some embodiments of the present disclosure.

FIG. 5 illustrates an exploded view of an acoustic device in accordance with some embodiments of the present disclosure. The acoustic device may be similar to the acoustic device 4*a* in FIG. 4. As shown in FIG. 5, a baffle 17 may be disposed between the vibration structure 13 and the cushion 15 (which may include or be an ear pad). In some embodiments, the through hole O1 defined on the chamber 12 may have a diameter between 4 mm and 6 mm, e.g., about 5 mm, and the through hole O2 defined on the separation structure 125 may have a diameter between 2 mm and 3 mm. The chamber 12 and/or the separation structure 125 may have a cap shape. The chamber 12 covers the baffle 17, the vibration structure 13 and the separation structure 125 on the cushion 15. The separation structure 125 covers the vibration structure 13 on the baffle 17.

As used herein, the terms "approximately," "substantially," "substantial" and "about" are used to describe and account for small variations. When used in conjunction with an event or circumstance, the terms can refer to instances in which the event or circumstance occurs precisely as well as instances in which the event or circumstance occurs to a close approximation. For example, when used in conjunction with a numerical value, the terms can refer to a range of variation less than or equal to +10% of that numerical value, such as less than or equal to +5%, less than or equal to +4%, less than or equal to +3%, less than or equal to +2%, less than or equal to +1%, less than or equal to +0.5%, less than or equal to +0.1%, or less than or equal to +0.05%. For example, two numerical values can be deemed to be "substantially" or "about" the same if a difference between the values is less than or equal to +10% of an average of the values, such as less than or equal to ±5%, less than or equal to +4%, less than or equal to +3%, less than or equal to +2%, less than or equal to +1%, less than or equal to +0.5%, less than or equal to +0.1%, or less than or equal to ±0.05%. For example, "substantially" parallel can refer to a range of angular variation relative to 0° that is less than or equal to ±10°, such as less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°. For example, "substantially" perpendicular can refer to a range of angular variation relative to 90° that is less than or equal to ±10°, such as less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°.

Two surfaces can be deemed to be coplanar or substantially coplanar if a displacement between the two surfaces is no greater than 5 μm, no greater than 2 μm, no greater than 1 μm, or no greater than 0.5 μm. A surface can be deemed to be planar or substantially planar if a difference between a highest point and a lowest point of the surface is no greater than 5 μm, no greater than 2 μm, no greater than 1 μm, or no greater than 0.5 μm.

As used herein, the singular terms "a," "an," and "the" may include plural referents unless the context clearly dictates otherwise. In the description of some embodiments, a component provided "on" or "over" another component can encompass cases where the former component is directly on (e.g., in physical contact with) the latter component, as well as cases where one or more intervening components are located between the former component and the latter component.

While the present disclosure has been described and illustrated with reference to specific embodiments thereof, these descriptions and illustrations do not limit the present disclosure. It can be clearly understood by those skilled in the art that various changes may be made, and equivalent components may be substituted within the embodiments without departing from the true spirit and scope of the present disclosure as defined by the appended claims. The illustrations may not necessarily be drawn to scale. There may be distinctions between the artistic renditions in the present disclosure and the actual apparatus, due to variables in manufacturing processes and such. There may be other embodiments of the present disclosure which are not specifically illustrated. The specification and drawings are to be regarded as illustrative rather than restrictive. Modifications may be made to adapt a particular situation, material, composition of matter, method, or process to the objective, spirit and scope of the present disclosure. All such modifications are intended to be within the scope of the claims appended hereto. While the methods disclosed herein have been described with reference to particular operations performed in a particular order, it can be understood that these operations may be combined, sub-divided, or re-ordered to form an equivalent method without departing from the teachings of the present disclosure. Therefore, unless specifically indicated herein, the order and grouping of the operations are not limitations of the present disclosure.

What is claimed is:

1. An acoustic device, comprising:

a first chamber comprising a first end and a second end;

a first through hole defined at the first end of the first chamber;

a vibration structure disposed at the second end of the first chamber and configured to transmit an acoustic wave away from the first chamber; and a separation structure disposed within the first chamber and dividing the first chamber into a first sub-chamber and a second sub-chamber, wherein the separation structure defines a second through hole connecting the first sub-chamber and the second sub-chamber, the first through hole has a first volume and the second through hole has a second volume, a ratio of the first volume to the second volume is greater than 1 and equal to or less than 1.2, and the second hole has a circular shape with a radius R2 and a depth T2, the second volume is $\pi*R2^2*T2$, the first hole has a circular shape with a radius R1 and a depth T1, and the first volume is $\pi*R1^2*T1$.

2. The acoustic device of claim 1, wherein a volume of the first sub-chamber is equal to or greater than a volume of the second sub-chamber.

3. The acoustic device of claim 2, wherein the volume of the first sub-chamber is less than or equal to two times the volume of the second sub-chamber.

4. The acoustic device of claim 1, further comprising a second chamber adjacent to the second end of the first chamber, wherein the vibration structure is between the first chamber and the second chamber.

5. The acoustic device of claim 1, wherein a central axis of the first through hole is different from a central axis of the second through hole.

6. The acoustic device of claim 1, wherein the separation structure defines at least two through holes.

7. The acoustic device of claim 1, wherein the separation structure further defines a hole configured for an audio wire to pass through.

8. The acoustic device of claim 7, further comprising an adhesive material fixing the audio wire in the hole and sealing a space between the audio wire and the hole.

9. The acoustic device of claim 1, wherein a central axis of the first through hole is the same as a central axis of the second through hole.

10. An acoustic device, comprising:

a first chamber comprising a first end and a second end;

a first through hole defined at the first end of the first chamber;

a vibration membrane disposed at the second end of the first chamber and configured to transmit an acoustic wave away from the first chamber; and a separation structure disposed within the first chamber and defining a first sub-chamber and a second sub-chamber, wherein the separation structure defines a second through hole connecting the first sub-chamber and the second sub-chamber, and a volume of the first sub-chamber is equal to or greater than a volume of the second sub-chamber and equal to or less than two times the volume of the second sub-chamber, and the first through hole defines a first volume and the second through hole defines a second volume, and a ratio of the first volume to the second volume is greater than 1 and equal to or less than 1.2, and the second hole has a circular shape with a radius R2 and a depth T2, the second volume is $\pi*R2^2*T2$, the first hole has a circular shape with a radius R1 and a depth T1, and the first volume is $\pi*R1^2*T1$.

11. The acoustic device of claim 10, further comprising a second chamber adjacent to the second end of the first chamber, wherein the vibration membrane is between the first chamber and the second chamber.

12. The acoustic device of claim 10, wherein a central axis of the first through hole is different from a central axis of the second through hole.

13. The acoustic device of claim 10, wherein the separation structure defines at least two through holes.

14. The acoustic device of claim 13, wherein the separation structure further defines a wire hole configured for an audio wire to pass through.

15. The acoustic device of claim 14, further comprising an adhesive material fixing the audio wire in the wire hole and sealing a space between the audio wire and the separation structure.

16. The acoustic device of claim 10, wherein a central axis of the first through hole is the same as a central axis of the second through hole.

17. An acoustic device, comprising:

a first chamber and a second chamber;

a membrane disposed between the first chamber and the second chamber; and a separation structure disposed within the second chamber to divide the second chamber into a first sub-chamber and a second sub-chamber, the separation structure having a first hole connecting the first sub-chamber and the second sub-chamber, wherein the second chamber has a second hole penetrating the second chamber, the first hole has a first volume and the second hole has a second volume, the first hole has a circular shape with a radius R2 and a depth T2, the first volume is $\pi*R2^2*T2$, the second hole has a circular shape with a radius R1 and a depth T1, and the second volume is $\pi*R1^2*T1$, and a ratio of the second volume to the first volume is greater than 1 and equal to or less than 1.2.

18. The acoustic device of claim 17, wherein the second hole is located at a surface of the second chamber spaced apart from the separation structure.

19. The acoustic device of claim 17, wherein a projection of the second hole on the separation structure does not overlap the first hole.

20. The acoustic device of claim 17, wherein the separation structure comprises a third hole through which an audio wire passes.

21. The acoustic device of claim 17, wherein a projection of the second hole on the separation structure overlaps the first hole.

22. An acoustic device, comprising:

a first chamber comprising a first end and a second end;

a first through hole defined at the first end of the first chamber;

a vibration structure disposed at the second end of the first chamber and configured to transmit an acoustic wave away from the first chamber; and a separation structure disposed within the first chamber and dividing the first chamber into a first sub-chamber and a second sub-chamber, wherein the separation structure defines a second through hole connecting the first sub-chamber and the second sub-chamber, and a distance is defined between a central axis of the first through hole and a central axis of the second through hole, the separation structure defines a length, and a ratio of the distance to the length is in a range between 0.5 and 0.9, wherein the first through hole has a first volume and the second through hole has a second volume, and a ratio of the first volume to the second volume is greater than 1 and equal to or less than 1.2, and the second hole has a circular shape with a radius R2 and a depth T2, the second volume is $\pi*R2^2*T2$, the first hole has a circular shape with a radius R1 and a depth T1, and the first volume is $\pi*R1^2*T1$.

23. The acoustic device of claim 22, wherein the distance is defined between an intersection of the central axis of the first through hole and the separation structure and an intersection of the central axis of the second through hole and the separation structure.

24. The acoustic device of claim 22, wherein the central axis of the first through hole is perpendicular to the separation structure.

25. The acoustic device of claim 22, wherein the central axis of the first through hole is in parallel with the separation structure.

26. The acoustic device of claim 22, wherein a diameter of the first through hole is greater than a diameter of the second through hole.

27. The acoustic device of claim 26, wherein the diameter of the first through hole is between 4 mm and 6 mm, and the diameter of the second through hole is between 2 mm and 3 mm.

28. The acoustic device of claim 22, wherein a volume of the first sub-chamber is greater than a volume of the second sub-chamber and equal to or less than two times the volume of the second sub-chamber.

* * * * *